US007950555B1

(12) United States Patent
Dewald

(10) Patent No.: US 7,950,555 B1
(45) Date of Patent: May 31, 2011

(54) STACKABLE DESK-TOP TAPE DISPENSER AND STAPLER

(76) Inventor: Steven P Dewald, Broken Arrow, OK (US)

( * ) Notice: Subject to any disclaimer, the term of this patent is extended or adjusted under 35 U.S.C. 154(b) by 1031 days.

(21) Appl. No.: 11/312,729

(22) Filed: Dec. 20, 2005

(51) Int. Cl.
*B25C 5/00* (2006.01)

(52) U.S. Cl. ..... 227/120; 227/156

(58) Field of Classification Search ..... 227/76, 227/120, 156, 63; 7/160; 220/784
See application file for complete search history.

(56) References Cited

U.S. PATENT DOCUMENTS

| | | | | |
|---|---|---|---|---|
| 3,596,820 | A * | 8/1971 | Lou | 227/106 |
| 4,163,515 | A * | 8/1979 | Kapuscinski | 227/120 |
| 4,727,610 | A | 3/1988 | Lin | |
| 4,752,023 | A * | 6/1988 | Lin | 225/26 |
| 4,793,537 | A | 12/1988 | Amagaya | |
| D310,103 | S * | 8/1990 | Beirise et al. | D19/67 |
| D354,515 | S * | 1/1995 | Vu | D19/67 |
| D377,950 | S | 2/1997 | Shen et al. | |
| 6,311,923 | B1 * | 11/2001 | Tsai | 242/598.5 |
| D524,616 | S * | 7/2006 | Cetera | D8/49 |
| D528,884 | S * | 9/2006 | Shevin-Sandy | D8/49 |
| 7,143,922 | B2 * | 12/2006 | Shevin-Sandy | 227/156 |
| 2006/0026769 | A1 | 2/2006 | Shevin-Sandy | |

FOREIGN PATENT DOCUMENTS

| | | |
|---|---|---|
| JP | 2002273670 | 3/2001 |

OTHER PUBLICATIONS

Tony Vatter, Huron Area Technical Center, Bad Axe, MI, 3 pages printed off website www.dimensionprinting.com regarding article on "The Tapeler".

* cited by examiner

*Primary Examiner* — Rinaldi I Rada
*Assistant Examiner* — Nathaniel Chukwurah
(74) *Attorney, Agent, or Firm* — Gable Gotwals

(57) ABSTRACT

A stapler is stacked on top of a roll-type tape dispenser. The tape dispenser top surface and the stapler base bottom surface have complemental three dimensional contours which cause the tape dispenser and stapler longitudinal axes to be in parallel relationship when the surfaces are in abutment, prevent relative displacement of the tape dispenser and the stapler when they are stacked and permit the stapler to be dismounted from the tape dispenser and rested for separate use on a flat surface in a stable condition.

16 Claims, 3 Drawing Sheets

STACKABLE DESK-TOP TAPE DISPENSER AND STAPLER

BACKGROUND OF THE INVENTION

This invention relates generally to desk-top accessories and more particularly concerns a stackable arrangement of a tape dispenser and a stapler.

Convenience is a most desirable feature for desk-top activities. We want to keep all our desk-top tools and gadgets in immediately accessible locations without cluttering up our working desk-top area. The concepts tend to be mutually exclusive.

Desk-top accessories frequently include a tape dispenser and a stapler. They generally rest side-by-side on the desk-top. The more often they are used, the more likely they will have relatively heavy bases covering a large surface area so as to be more stable during use. In order to conserve space, some unitary tape dispenser/stapler combinations have been designed in which the tape dispenser is mounted above or laterally in relation to the stapler. Unitary combinations prohibit separated use and, therefore, merely permit a choice of inconveniences. If the combination is a tape dispenser stacked on top of a stapler, the use of either accessory becomes unstable. In using the stapler, it is necessary to press down on the tape dispenser, an awkward procedure since the tape generally extends from its roll to the cutter which is above the punch end of the stapler. Therefore, in punching a staple, the tape is likely to be messed up. In using the tape dispenser, its base pivots as part of the stapler arm and makes the cutting operation more difficult.

It is, therefore, an object of this invention to provide a stackable tape dispenser and stapler combination. Another object of this invention is to provide a separable stackable tape dispenser and stapler combination. It is also an object of this invention to provide a stackable combination in which a tape dispenser and a stapler are stable during use in a stacked condition. Yet another object of this invention is to provide a stackable combination in which a tape dispenser and a stapler are stable during use in a separated condition. A further object of this invention is to provide a stackable tape dispenser and stapler combination in which the stapler is stacked above the tape dispenser.

SUMMARY OF THE INVENTION

In accordance with the invention, a stackable tape dispenser/stapler combination is provided. A roll-type tape dispenser is configured to dispense tape approximately along its longitudinal axis as the roll of tape rotates about a rotational axis perpendicular to its longitudinal axis. A stapler stacked on top of the tape dispenser has an arm configured to advance staples approximately along its longitudinal axis and pivoted on a base about a rotational axis perpendicular to its longitudinal axis to eject staples against the base. The dispenser has a top surface and the stapler base has a bottom surface which are contoured for abutment. The top and bottom surfaces have complemental three dimensional contours. The contours cause the tape dispenser and stapler longitudinal axes to be in parallel relationship when the surfaces are in abutment.

Preferably, the contours have wave-like cross-sections in taken vertical planes parallel to the longitudinal axes and tongue-and-groove-type cross-sections taken in a vertical planes parallel to the rotational axes. The longitudinal axis contours prevent relative displacement of the dispenser and the stapler in the direction of the longitudinal axes and the rotational axis contours prevent relative displacement of the dispenser and the stapler in the directions of the rotational axes when the tape dispenser and the staples are stacked.

The contours of the stapler lower surface have lowermost points defining a single plane parallel to the longitudinal and rotational axes of the stapler with some of the lowermost points proximate the rear of the stapler and others proximate the front of stapler so that the stapler can be dismounted from the tape dispenser and rested for separate use on a flat surface in a stable condition.

Similarly, the contours of the tape dispenser upper surface have uppermost points defining a single plane parallel to the longitudinal and rotational axes of the dispenser. The uppermost points of the tape dispenser upper surface and the top surface of the stapler base define a single plane so that, in the stacked condition, the top face of the stapler base is horizontal and the uppermost points of the tape dispenser extend the horizontal working surface of the stapler base.

In the preferred embodiment, the roll-type tape dispenser has a body and a spindle. The body has a top surface of wave-like longitudinal cross-section in a vertical plane with forward, central and rear crests. The forward and rear crests are in a common horizontal plane and the central crest is in a plane lower than the common plane and has a hollow. The spindle is journalled in the central crest to dispense tape to a cutter on the forward crest as the roll of tape rotates with the spindle about the first rotational axis. The stapler has a base and an arm. The arm is configured to advance staples along the second longitudinal axis and is pivoted on the base about the second rotational axis to eject staples downwardly against the base. The stapler base has a horizontal top surface and a bottom surface of wave-like longitudinal cross-section in a vertical plane with forward and rear nadirs. The nadirs are in a common horizontal plane and have hollows. The stapler bottom surface and the dispenser top surface are contoured for abutment with the hollows aligned to contain the roll of tape.

BRIEF DESCRIPTION OF THE DRAWINGS

Other objects and advantages of the invention will become apparent upon reading the following detailed description and upon reference to the drawings in which.

While the invention will be described in connection with a preferred embodiment thereof, it will be understood that it is not intended to limit the invention to that embodiment or to the details of the construction or arrangement of parts illustrated in the accompanying drawings.

DETAILED DESCRIPTION

Figure 1:
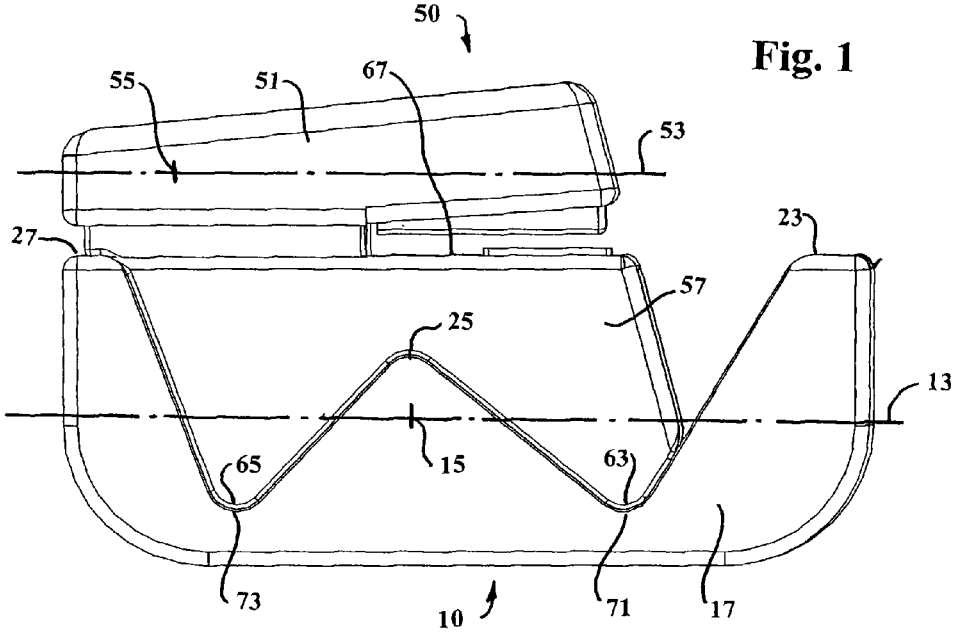
FIG. 1 is a right side elevation view of the stacked tape dispenser/stapler combination.
Figure 10:
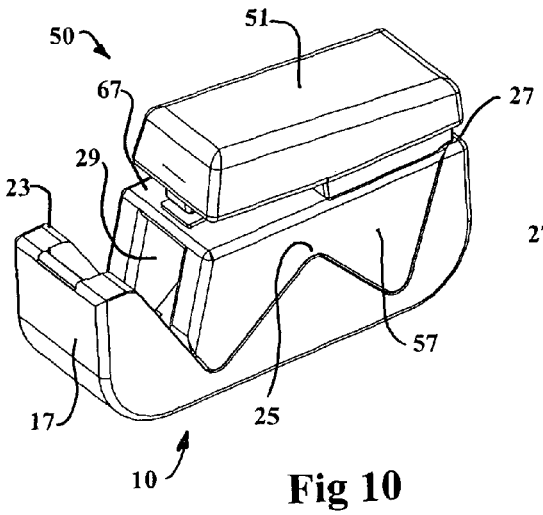
FIG. 10 is a front left perspective view of the stacked combination of FIG. 1.
Figure 11:
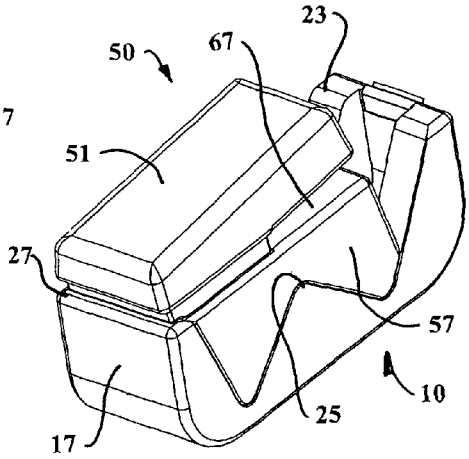
FIG. 11 is a rear right perspective view of the stacked combination of FIG. 1.
Figure 2:
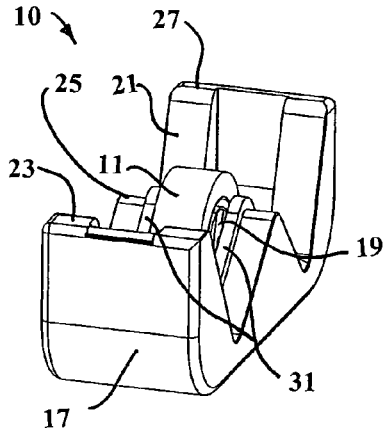
FIG. 2 is a left front perspective view of the tape dispenser of FIG. 1.
Figure 3:
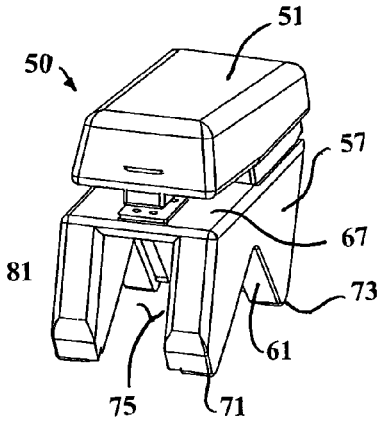
FIG. 3 is a left front perspective view of the stapler of FIG. 1.
Figure 4:
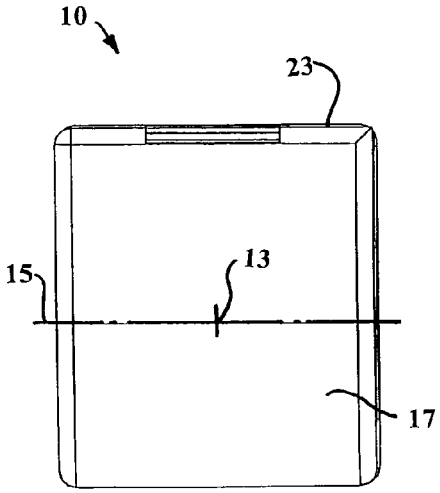
FIG. 4 is a front elevation view of the tape dispenser of FIG. 1.
Figure 5:
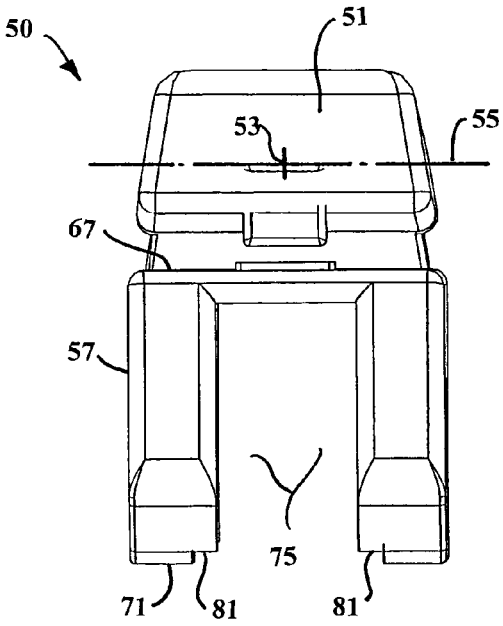
FIG. 5 is a front elevation view of the stapler of FIG. 1.
Figure 8:
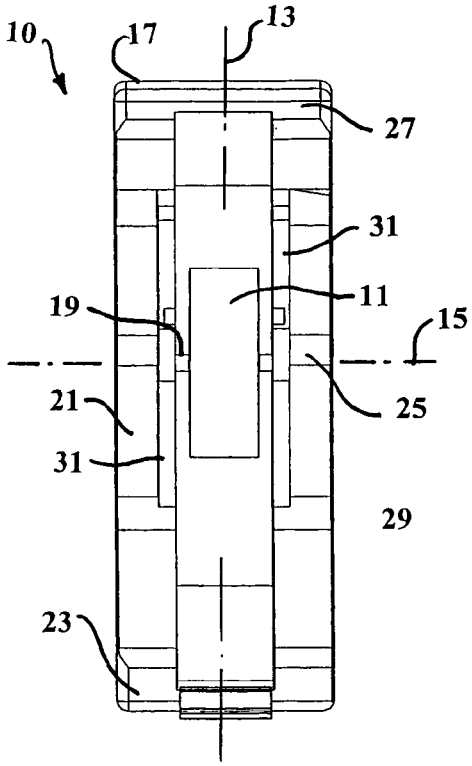
FIG. 8 is a top plan view of the tape dispenser of FIG. 1.
Figure 9:
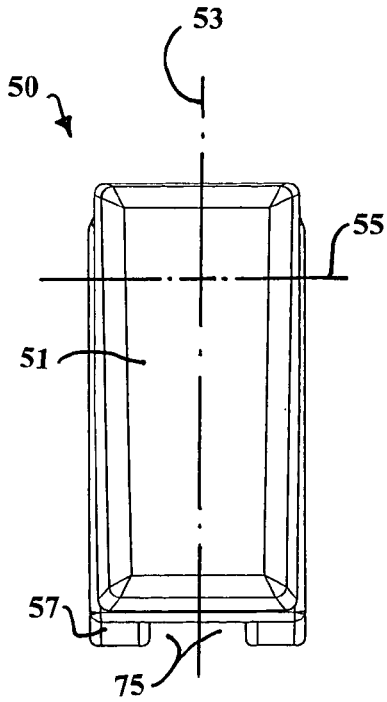
FIG. 9 is a top plan view of the stapler of FIG. 1.
Figure 6:
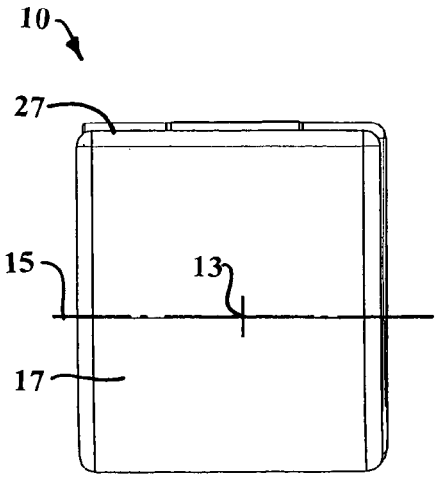
FIG. 6 is a rear elevation view of the tape dispenser of FIG. 1.
Figure 7:
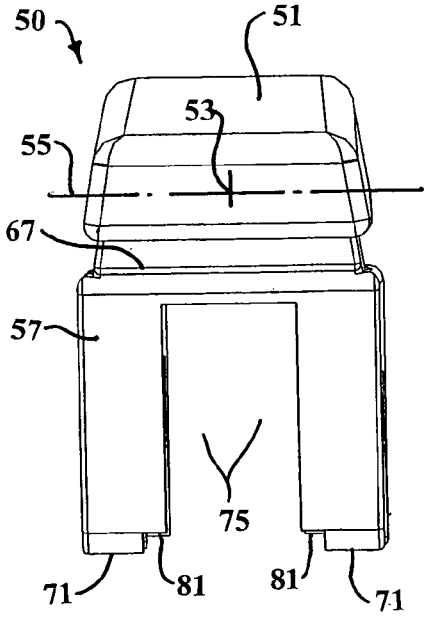
FIG. 7 is a rear elevation view of the stapler of FIG. 1.

Turning to FIG. 1, a tape dispenser 10 and stapler 50 are shown in a stacked relationship. As best seen in FIGS. 2 and 8, the roll-type tape dispenser 10 is configured to dispense tape 11 in approximately the direction of its longitudinal axis 13 as the roll of tape 11 rotates about a rotational axis 15 perpendicular to its longitudinal axis 13. As best seen in FIGS. 3, 5 and 9, the stapler 50 has an arm 51 configured to advance staples approximately along its longitudinal axis 53. The arm 51 pivots about a rotational axis 57 on its base 55 perpendicular its longitudinal axis 53 to eject staples against its base 57. Looking at FIGS. 1, 2 and 3, the tape dispenser 10 has a top surface 21 and the stapler 50 has a bottom surface 61 which are contoured for abutment. As shown, the tape dispenser top and stapler bottom surfaces 21 and 61 have complemental three dimensional contours. The contours cause the tape dispenser and stapler longitudinal axes 13 and 53 and rotational axes 15 and 55 to be in parallel relationship when the contoured surfaces 2-1 and 61 are in abutment, prevent relative displacement of the tape dispenser 10 and the stapler 50 when they are stacked and permit the stapler 50 to be stable during use on a level surface if it is unstacked from the tape dispenser 10.

The tape dispenser 10 is seen with the stapler 50 dismounted in FIGS. 2, 4, 6 and 8. In the embodiment shown, the tape 10 has a body 17 and a spindle 19. The body 17 as a top surface 21 of wave-like longitudinal cross-sections taken in vertical planes with forward 23, central 25 and rear 27 crests. The forward 23 and rear 27 crests are in a common horizontal plane and the central crest 25 is in a plane lower than the common plane. The central crest 25 has a hollow 29 and the spindle 19 is journalled in the central crest 25. The roll of tape 11 is mounted on the spindle 19 and is free to rotate in the hollow 29 about the rotation axis 15. The tape 11 is dispensed to a cutter on the top of the forward crest 23. The forward 23 and rear 27 crests define a single plane parallel to the longitudinal and rotational axes 13 and 15 of the tape dispenser 10 for reasons hereinafter discussed. The contour of the dispenser top surface 21 also has ridges 31 in cross-sections taken in vertical planes parallel to the tape rotational axis 15, also for reasons hereinafter discussed.

The stapler 50 is seen dismounted from the tape dispenser 10 in FIGS. 3, 5, 7 and 9. The contour of the stapler lower surface 61 has forward and rear lowermost points 63 and 65, respectively, defining a single plane parallel to the longitudinal and rotational axes 53 and 57 of the stapler 50. The rear lowermost points 65 are proximate the rear of the stapler 50 and the forward lowermost points 63 are proximate the front of stapler 50 so that the dismounted stapler 50 can be rested in a stable condition for separate use on a flat surface. As shown, the stapler base 57 has a horizontal top surface 67 and its bottom surface 61 has wave-like longitudinal cross-sections taken in vertical planes with forward 71 and rear 73 nadirs. The nadirs 71 and 73 are in a common horizontal plane and have hollows 75. The stapler bottom surface 61 and the dispenser top surface 21 are complemental and contoured for abutment with the hollow 29 in the tape dispenser 10 and the hollows 75 in the stapler base 57 aligned to contain the roll of tape 11. As shown, the forward and rear crests 23 and 27 of the dispenser upper surface 21 and the top surface 67 of the stapler base 57 define a single plane so that, in the stacked condition, the top face 67 of the stapler base 55 is horizontal and the forward crest 23 of the tape dispenser 10 is in the same horizontal plane so as to extend the working surface of the stapler base 57. The contour of the stapler lower surface 61 also has grooves 81 in cross-sections taken in vertical planes parallel to the stapler rotational axis 55 The stapler grooves 81 are complemental to the tape dispenser ridges 31 to provide a tongue and groove type of interlock to prevent relative displacement of the tape dispenser 10 and the stapler 50 in the direction of their rotational axes 15 and 55 when they are stacked.

Thus it is apparent that there has been provided, in accordance with the invention, a stackable desk-top tape dispenser and stapler combination that fully satisfies the objects, aims and advantages set forth above. While the invention has been described in conjunction with a specific embodiment thereof, it will be evident that many alternatives, modifications and variations will be apparent to those skilled in the art and in light of the forgoing description. Accordingly, it is intended to embrace all such alternatives, modifications and variations as fall within the spirit of the appended claims.

What is claimed is:

1. A desktop accessory comprising:

a roll-type tape dispenser configured to dispense tape approximately along a first longitudinal axis as the roll of tape rotates about a first rotational axis perpendicular to said longitudinal axis, said dispenser having a top surface; and a stapler having an arm configured to advance staples approximately along a second longitudinal axis and pivoted on a base about a second rotational axis perpendicular to said second longitudinal axis to eject staples against said base, said base having a bottom surface;

said stapler bottom surface and said dispenser top surface having corresponding contours oriented to permit a stable abutment thereof with said stapler seated on said tape dispenser, said abutment preventing relative non-vertical displacement between said tape dispenser and said stapler.

2. A desktop accessory according to claim 1, said longitudinal axes being parallel.

3. A desktop accessory according to claim 1, said top and bottom surfaces having complemental three dimensional contours.

4. A desktop accessory according to claim 3, said contours causing said longitudinal axes to be in parallel relationship when said surfaces are in abutment.

5. A desktop accessory according to claim 4, said contours preventing relative displacement of said dispenser and said stapler in the direction of said longitudinal axes.

6. A desktop accessory according to claim 5, said contours having a wave-like cross-section in a vertical plane parallel to said longitudinal axes.

7. A desktop accessory according to claim 4, said contours preventing relative displacement of said dispenser and said stapler in the direction of said rotational axes.

8. A desktop accessory according to claim 7, said contours having a tongue-and-groove-type cross-section in a vertical plane parallel to said rotational axes.

9. A desktop accessory according to claim 4, said contours preventing relative displacement of said dispenser and said stapler in the directions of said longitudinal and rotational axes.

10. A desktop accessory according to claim 3, said contours of said stapler lower surface having lowermost points defining a single plane parallel to said longitudinal and rotational axes of said stapler.

11. A desktop accessory according to claim 10, some of said lowermost points being proximate a rear of said stapler and others of said lowermost points being proximate a front of stapler.

12. A desktop accessory according to claim 3, said contours of said dispenser upper surface having uppermost points defining a single plane parallel to said longitudinal and rotational axes of said dispenser.

13. A desktop accessory according to claim 12, said uppermost points of said dispenser upper surface and a top surface of said base of said stapler defining a single plane.

14. A desktop accessory comprising:

a roll-type tape dispenser having a body and a spindle, said body having a top surface of wave-like longitudinal cross-section in a vertical plane with forward, central and rear crests, said forward and rear crests being in a common horizontal plane and said central crest being in a plane lower than said common plane and having a hollow therein, and said spindle being journalled in said central crest to dispense tape approximately along a first longitudinal axis to said forward crest as the roll of tape rotates with said spindle about a first rotational axis perpendicular to said longitudinal axis, and a stapler having a base and an arm, said arm configured to advance staples stored therein approximately along a second longitudinal axis and pivoted on said base about a second rotational axis perpendicular to said second longitudinal axis to eject staples downwardly against said base, said base having a horizontal top surface and a bottom surface of wave-like longitudinal cross-section in a vertical plane with forward and rear nadirs, said nadirs being in a common horizontal plane and having hollows therein;

said stapler bottom surface and said dispenser top surface having corresponding contours oriented to permit a stable abutment thereof with said stapler seated on said tape dispenser and with said hollows aligned to contain the roll of tape, said abutment preventing relative non-vertical displacement between said tape dispenser and said stapler.

15. A desktop accessory according to claim 14, said stapler bottom surface and said dispenser top surface having a longitudinal tongue-and-groove aligned to mate when said stapler is seated on said dispenser.

16. A desktop accessory according to claim 15, said stapler bottom surface having longitudinal grooves on opposite sides of said stapler hollow and said dispenser top surface having longitudinal tongues on opposite sides of said dispenser hollows, said tongues and grooves being aligned to mate when said stapler is seated on said dispenser.

* * * * *